US009720359B2

(12) United States Patent
Ishida et al.

(10) Patent No.: US 9,720,359 B2
(45) Date of Patent: Aug. 1, 2017

(54) FIXING DEVICE AND IMAGE FORMING APPARATUS PROVIDED WITH THE SAME

(71) Applicant: Brother Kogyo Kabushiki Kaisha, Nagoya-shi, Aichi-ken (JP)

(72) Inventors: Kei Ishida, Inuyama (JP); Takuji Matsuno, Ichinomiya (JP); Keita Shimizu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/082,021

(22) Filed: Mar. 28, 2016

(65) Prior Publication Data

US 2016/0306307 A1 Oct. 20, 2016

(30) Foreign Application Priority Data

Apr. 20, 2015 (JP) ..... 2015-086065

(51) Int. Cl.
*G03G 15/00* (2006.01)
*G03G 15/20* (2006.01)

(52) U.S. Cl.
CPC . *G03G 15/2053* (2013.01); *G03G 2215/2035* (2013.01)

(58) Field of Classification Search
USPC .... 399/75, 90, 107, 110, 122, 320, 328, 329
See application file for complete search history.

(56) References Cited

U.S. PATENT DOCUMENTS 9,069,305 B2 * 6/2015 Suzuki ..... G03G 15/2053 399/329

FOREIGN PATENT DOCUMENTS

JP 2010-164636 A 7/2010

* cited by examiner

*Primary Examiner* — Hoan Tran
(74) *Attorney, Agent, or Firm* — Banner & Witcoff, Ltd.

(57) ABSTRACT

A fixing device includes a frame, a first fixing member, a second fixing member, a first conducting member, and a second conducting member. The second fixing member includes a belt configured to form a nip region. The first fixing member is positioned at a first side and the second fixing member is positioned at a second side opposite to the first side. The first conducting member includes a first contacting portion exposed to an outside from the frame, and a first connecting portion electrically connecting the first fixing member and the first contacting portion. The second conducting member includes a second contacting portion exposed to an outside from the frame, and a second connecting portion electrically connecting the second fixing member and the second contacting portion. Both of the first contacting portion and the second contacting portion are positioned at one of the first side and the second side.

23 Claims, 4 Drawing Sheets

FIXING DEVICE AND IMAGE FORMING APPARATUS PROVIDED WITH THE SAME

CROSS REFERENCE TO RELATED APPLICATION

This application claims priority from Japanese Patent Application No. 2015-086065 filed Apr. 20, 2015. The entire content of the priority application is incorporated herein by reference.

TECHNICAL FIELD

The present disclosure relates to an electro-photographic type image forming apparatus, and to a fixing device provided in the image forming apparatus.

BACKGROUND

A conventional fixing device includes a pressure roller and a fixing film in pressure contact with the pressure roller. The pressure roller is required to be grounded.

There is a conventional fixing device provided in an image forming apparatus. One of the fixing devices in the prior art includes am electrically conductive fixing film, a heater in contact with an inner surface of the fixing film, a pressure roller providing a nip region in cooperation with the heater via the fixing film, a frame ground connected to an electric terminal provided in a housing of the image forming apparatus, and a capacitor electrically connecting a roller shaft of the pressure roller and the frame ground.

In such fixing device, the heater and the pressure roller apply heat and pressure to the sheet passing through the nip region, so that a toner image formed on the sheet is thermally fixed to the sheet.

SUMMARY

According to the disclosed fixing device, grounding of the fixing film is also required in addition to the grounding of the pressure roller. In such a conventional fixing device, a grounding passage extending from the fixing film and a grounding passage extending from the pressure roller are remote from each other. Therefore, access to the two grounding passages from the housing of the image forming apparatus would be troublesome.

It is therefore an object of the present disclosure to provide a fixing device capable of facilitating access to the grounding passages from the housing of the image forming apparatus.

According to one aspect, a fixing device includes a frame, a first fixing member supported to the frame, a second fixing member, a first conducting member, and a second conducting member. The second fixing member includes a belt configured to form a nip region in cooperation with the first fixing member. The first fixing member is positioned at a first side and the second fixing member is positioned at a second side opposite to the first side with respect to the nip region. The first conducting member has a first contacting portion exposed to an outside from the frame, and a first connecting portion electrically connecting the first fixing member and the first contacting portion. The second conducting member has a second contacting portion exposed to an outside from the frame, and a second connecting portion electrically connecting the second fixing member and the second contacting portion. At least one of the first connecting portion and the second connecting portion extends from the first side to the second side. Both of the first contacting portion and the second contacting portion are positioned at one of the first side and the second side.

According to another aspect, a fixing device is configured to be mounted in a casing of an image forming apparatus comprising a first body connecting portion. The fixing device includes a first fixing member, a second fixing member, a first conducting member, and a second conducting member. The second fixing member includes a belt configured to form a nip region in cooperation with the first fixing member. The first fixing member is positioned at a first side and the second fixing member is positioned at a second side opposite to the first side with respect to the nip region. The first conducting member has a first contacting portion configured to contact the first body connecting portion, and a first connecting portion electrically connects the first fixing member and the first contacting portion. The second conducting member has a second contacting portion configured to contact the first body connecting portion, and a second connecting portion electrically connecting the second fixing member and the second contacting portion. Both of the first contacting portion and the second contacting portion are positioned at the first side.

According to another aspect, a fixing device is configured to be mounted in a main body of an image forming apparatus comprising a first body connecting portion. The fixing device includes a first fixing member, a second fixing member, a first conducting member, and a second conducting member. The second fixing member includes a belt configured to form a nip region in cooperation with the first fixing member. The first fixing member is positioned at a first side and the second fixing member is positioned at a second side opposite to the first side with respect to the nip region. The first conducting member has a first plate spring including a first contacting portion configured to contact the first body connecting portion, and a first connecting portion electrically connecting the first fixing member and the first contacting portion. The second conducting member has a second plate spring including a second contacting portion configured to contact the first body connecting portion, and a second connecting portion electrically connecting the second fixing member and the second contacting portion. Both of the first plate spring and the second plate spring are positioned at the first side.

BRIEF DESCRIPTION OF THE DRAWINGS

The particular features and advantages of the disclosure will become apparent from the following description taken in connection with the accompanying drawings, in which.

DETAILED DESCRIPTION

Figure 1:
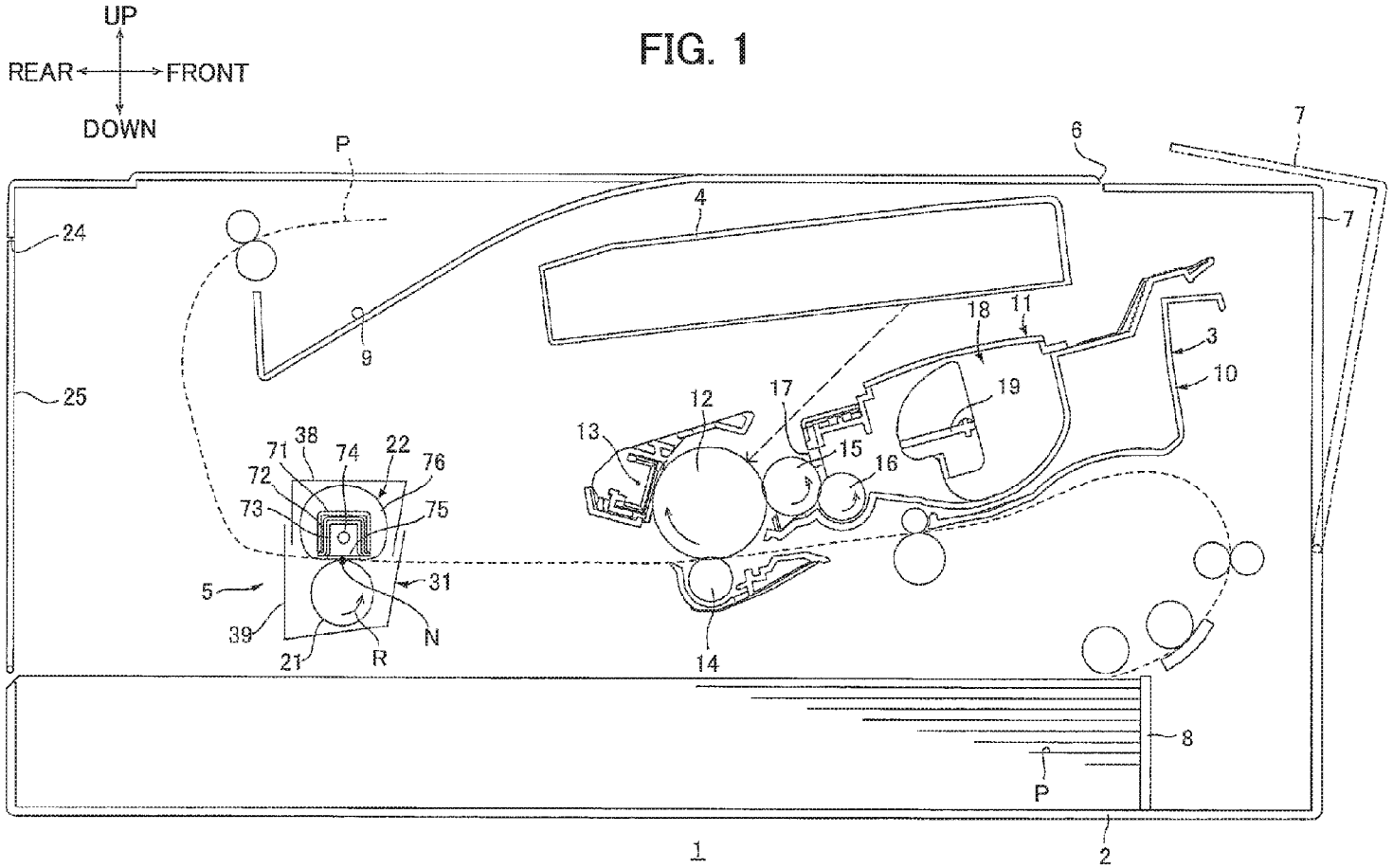
FIG. 1 is a cross-sectional view of a printer provided with a fixing device according to an embodiment.

A printer 1, one example of an image forming apparatus, according to a first embodiment will be described while referring to the accompanying drawings wherein like parts and components are designated by the same reference numerals to avoid duplicating description.

The terms "upward", "downward", "upper", "lower", "above", "below", "beneath", "right", "left", "front", "rear" and the like will be used throughout the description assuming that the printer 1 is disposed in an orientation in which it is intended to be used. In use, the printer 1 is disposed as shown in FIG. 1.

As illustrated in FIG. 1, the printer 1 is an electrophotographic type monochromatic printer. The printer 1 includes a main casing 2 formed with a first opening 6 and a second opening 24, a process cartridge 3, a scanner unit 4, and a fixing device 5.

The main casing 2 is generally box-shaped, and is provided with a front cover 7, a rear cover 25, a sheet supply tray 8, and a sheet discharge tray 9.

The first opening 6 is positioned at a front end portion of the main casing 2, and allows the process cartridge 3 to pass therethrough between an interior and exterior of the main casing 2 in the front-rear direction.

The second opening 24 is positioned at a rear end portion of the main casing 2, and allows communication therethrough between the interior and exterior of the main casing 2 in the front-rear direction.

The front cover 7 is positioned at the front end portion of the main casing 2 and is generally L-shaped in side view. The front cover 7 has a lower end portion pivotally movably supported to a front wall of the main casing 2 such that the front cover 7 opens and closes the first opening 6.

The rear cover 25 is positioned at the rear end portion of the main casing 2 and has a plate shape extending in the vertical direction. The rear cover 25 has a lower end portion pivotably supported to a rear wall of the main casing 2 such that the front cover 7 is pivotally moved to an open position opening the second opening 24 and to a closed position closing the second opening 24.

The sheet supply tray 8 is positioned at a bottom portion of the main casing 2, and is adapted to accommodate a sheet P.

The discharge tray 9 is positioned at an upper wall of the main casing 2, and is recessed downward from an upper surface of the main casing 2 for receiving the sheet P.

The process cartridge 3 is accommodated in the main casing 2 at a generally vertically center portion thereof. The process cartridge 3 is configured to be attached to and detached from the main casing 2 through the first opening 6. The process cartridge 3 includes a drum cartridge 10 and a developing cartridge 11.

The drum cartridge 10 includes a photosensitive drum 12, a scorotron charger 13 and a transfer roller 14.

The photosensitive drum 12 is rotatably supported to a rear end portion of a frame of the drum cartridge 10, and has a generally cylindrical shape extending in the left-right direction.

The scorotron charger 13 is positioned rearward of the photosensitive drum 12 and is spaced away therefrom.

The transfer roller 14 is positioned downward of the photosensitive drum 12, and is in contact with a lower end portion of the photosensitive drum 12.

The developing cartridge 11 is attached to the drum cartridge 10 at a position frontward of the photosensitive drum 12, and includes a developing roller 15, a supply roller 16, a layer thickness regulation blade 17, a toner chamber 18, and an agitator 19.

The developing roller 15 is rotatably supported to a rear end portion of a frame of the developing cartridge 11, and has a generally cylindrical shape extending in the left-right direction. The developing roller 15 is in contact with a front end portion of the photosensitive drum 12.

The supply roller 16 is positioned frontward and downward of the developing roller 15, and is rotatably supported to the frame of the developing cartridge 11. The supply roller 16 has a generally cylindrical shape extending in the left-right direction, and is in contact with a front lower end portion of the developing roller 15.

The layer thickness regulation blade 17 is positioned upward and frontward of the developing roller 15 and is in contact with a front end portion of the developing roller 15.

The toner chamber 18 is positioned frontward of the supply roller 16 and the layer thickness regulation blade 19 and is adapted to accommodate therein toner.

The agitator 19 is rotatably supported in the toner chamber 18.

The scanner unit 4 is positioned upward of the process cartridge 3, and is adapted to irradiate laser beam toward the photosensitive drum 12 on the basis of image data.

The fixing device 5 is positioned in the main casing 2 at a position rearward of the process cartridge 3 with a gap therebetween. The fixing device 5 includes a pressure roller 21 as an example of a first fixing member, and a heat unit 22 as an example of a second fixing member.

The pressure roller 21 constitutes a lower portion of the fixing device 5, and the heat unit 22 is positioned upward of the pressure roller 21 to face the pressure roller 21 in the vertical direction. The heat unit 22 is in contact with an upper end portion of the pressure roller 21 to provide a nip region N therebetween.

Upon start of the printing operation in the printer 1, the surface of the photosensitive drum 12 is uniformly charged by the scorotron charger 13, and the surface of the photosensitive drum 12 is exposed to light by the scanner unit 4 in accordance with the image data. Thus, an electrostatic latent image on the basis of the image data is formed on the surface of the photosensitive drum 12.

Further, toner in the toner chamber 18 is agitated by the agitator 19, and the agitated toner is supplied to the supply roller 16, and then the toner is supplied from the supply roller 16 to the developing roller 15. In this instance, triboelectric charging occurs in the toner interposed between the developing roller 15 and the supply roller 16, so that the toner having positive polarity is generated on the developing roller 15. The layer thickness regulation blade 17 regulates a thickness of the toner layer on the developing roller 15 into a uniform thickness.

The toner carried on the developing roller 15 is supplied to the electrostatic latent image formed on the surface of the photosensitive drum 12. Thus, a toner image is carried on the surface of the photosensitive drum 12

Each one of the sheets P is supplied to a position between the photosensitive drum 12 and the transfer roller 14 at a prescribed timing from the sheet supply tray 8 by rotation of various rollers. Thus, the toner image is transferred onto the sheet P when the sheet P is moved past between the photosensitive drum 12 and the transfer roller 14.

Then, the sheet P is entered into a position between the pressure roller 21 and the heat unit 22 in accordance with the rotation of the pressure roller 21. The sheet P is heated and pressed when the sheet P passes through the nip region N upon rotation of the pressure roller 21 and the heat unit 22. Thus, the toner image carried on the sheet P is thermally fixed to the sheet P. Then the sheet P is discharged on to the discharge tray 9.

Figure 2:
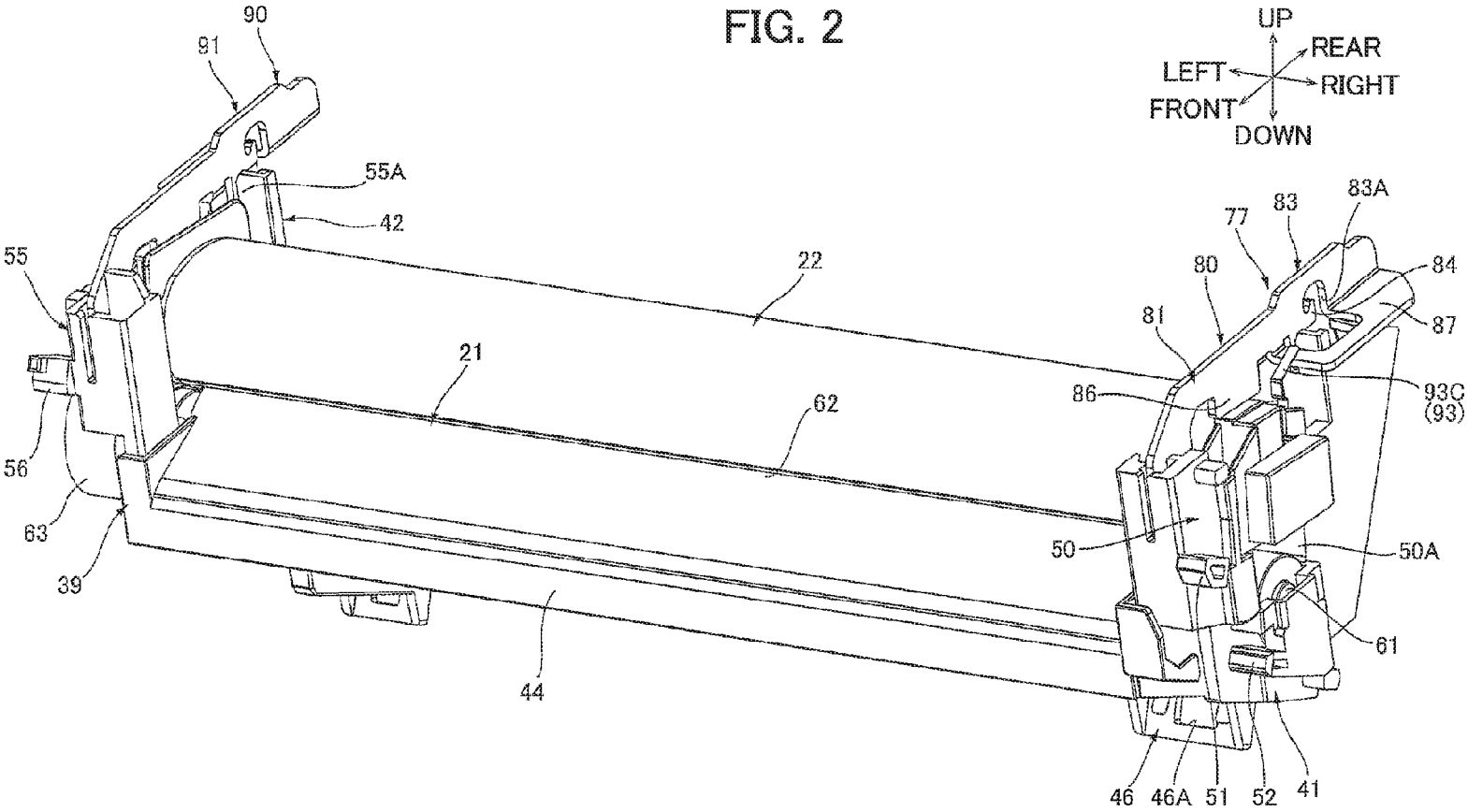
FIG. 2 is a perspective view of the fixing device according to the embodiment as viewed from above the fixing device.
Figure 4:
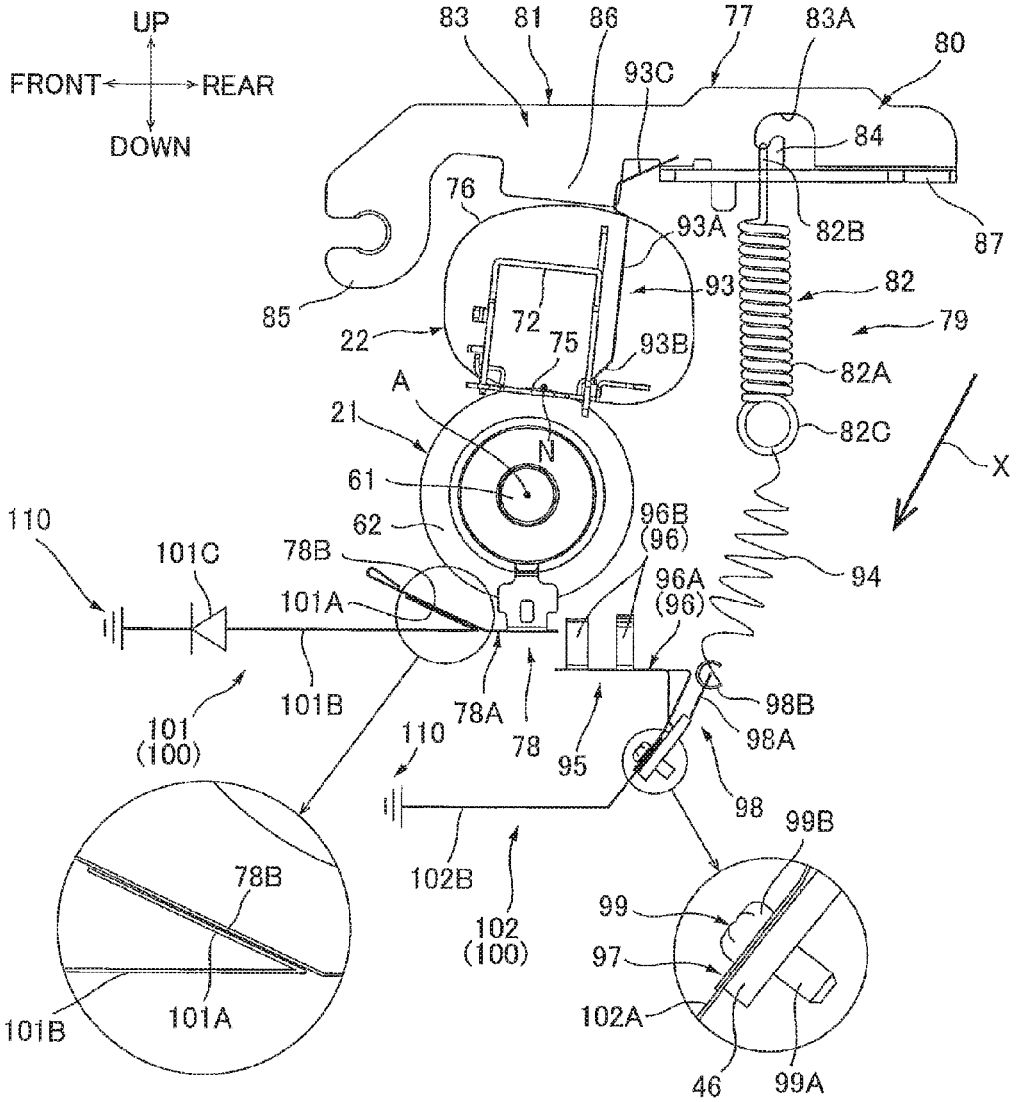
FIG. 4 is a view illustrating a grounding unit illustrated in FIG. 3B.

As shown in FIGS. 1, 2, and 4, in addition to the pressure roller 21 and heat unit 22 described above, the fixing device 5 includes a frame 31, a first pressing unit 80, a second pressing unit 90, and a grounding unit 77 as an example of a grounding member.

As shown in FIG. 1, the frame 31 has a box-like shape and is elongated in the left-right direction. The frame 31 includes a lower frame 39, and an upper frame 38.

The lower frame 39 constitutes the bottom section of the frame 31. The lower frame 39 is formed of a resin material. Note that the lower frame 39 may also contain known additives, such as glass fibers, metals, or ceramics. As shown in FIG. 2, the lower frame 39 is integrally provided with a first side wall 41, a second side wall 42, a bottom wall 43, a front wall 44, and a rear wall (not shown).

The first side wall 41 constitutes the right end portion of the lower frame 39. The first side wall 41 includes a first-side-wall body 50 having a first recessed portion 50A formed therein, a first engaging portion 51, a second engaging portion 52, and a first connecting shaft 54 (see FIG. 3B).

The first-side-wall body 50 has a plate shape that is generally rectangular in a side view. The first recessed portion 50A is recessed downward from the top edge of the first-side-wall body 50 at a position in the front-rear center thereof. The first recessed portion 50A has a general U-shape in a side view that is open on the top.

The first engaging portion 51 is disposed on the right surface of the first-side-wall body 50 at the front edge and in the approximate vertical center thereof. The first engaging portion 51 has a generally squared cylindrical shape and protrudes rightward from the right surface of the first-side-wall body 50.

The second engaging portion 52 is disposed on the right surface of the first-side-wall body 50. The second engaging portion 52 is positioned to the lower-rear side of the first engaging portion 51 and is separated from the same. The second engaging portion 52 has a general squared cylindrical shape and protrudes rightward from the right surface of the first-side-wall body 50.

Figure 3A:
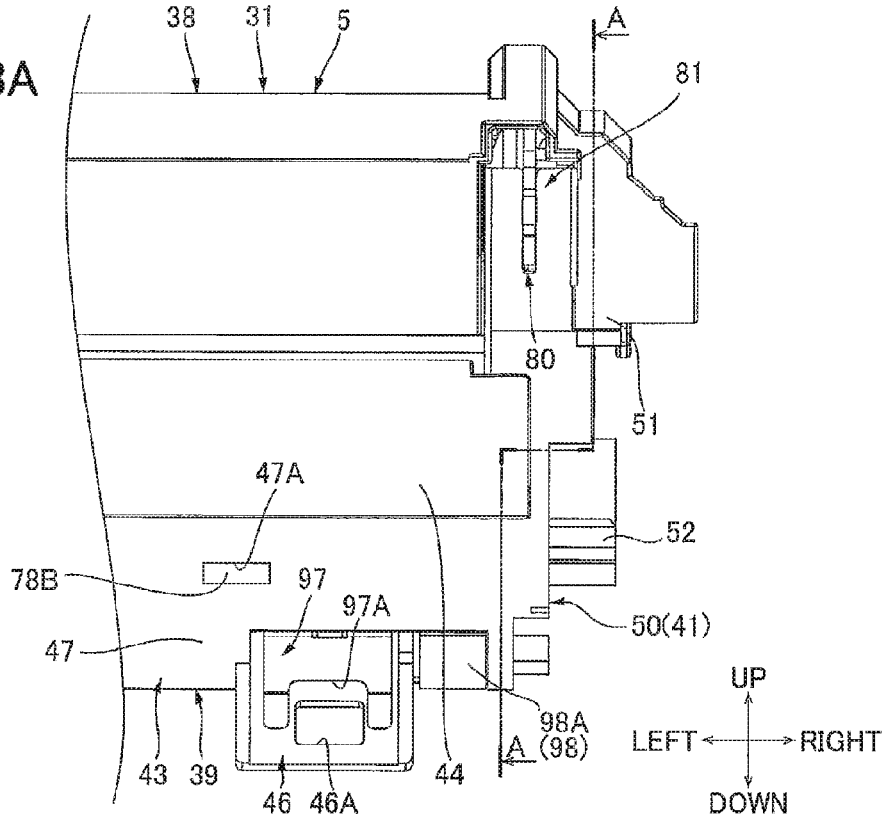
FIG. 3A is a front view of a right end portion of the fixing device according to the embodiment.
Figure 3B:
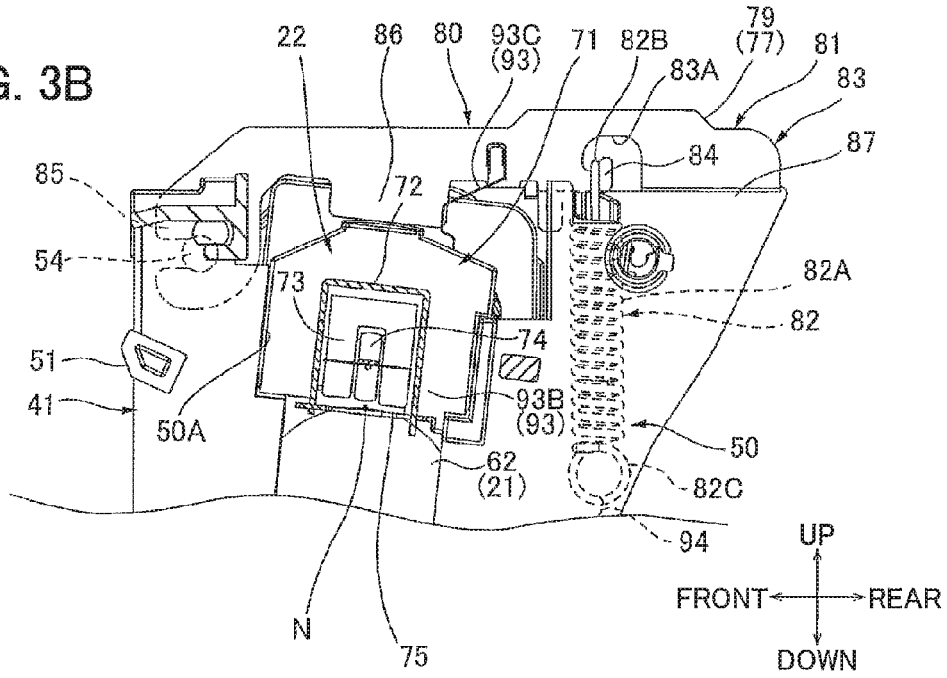
FIG. 3B is a cross-sectional view of the fixing device taken along a line A-A of FIG. 3A.

As shown in FIG. 3B, the first connecting shaft 54 is disposed on the left surface of the first-side-wall body 50 in the upper-front corner of the same. The first connecting shaft 54 has a general columnar shape and protrudes leftward from the left surface of the first-side-wall body 50.

As shown in FIG. 2, the second side wall 42 constitutes the left end portion of the lower frame 39. The second side wall 42 includes a second-side-wall body 55 having a second recessed portion 55A formed therein, a third engaging portion 56, and a second connecting shaft (not shown).

The second-side-wall body 55 has a plate shape that is generally rectangular in a side view. The second recessed portion 55A is recessed downward from the top edge of the second-side-wall body 55 in the front-rear center region of the same. The second recessed portion 55A has a general U-shape in a side view that is open on the top. The second recessed portion 55A is aligned with the first recessed portion 50A in the left-right direction. That is, the front-rear dimension of the second recessed portion 55A is equivalent to the front-rear dimension of the first recessed portion 50A.

The third engaging portion 56 is disposed on the left surface of the second-side-wall body 55 at a position on the front edge and in the approximate vertical center thereof. The third engaging portion 56 has a general squared cylindrical shape and protrudes leftward from the left surface of the second-side-wall body 55.

The second connecting shaft (not shown) is disposed on the right surface of the second-side-wall body 55 in the upper-front corner region thereof. The second connecting shaft is aligned with the first connecting shaft 54 in the left-right direction.

As shown in FIG. 3A, the bottom wall 43 spans between the bottom edges of the first side wall 41 and the second side wall 42. The bottom wall 43 includes a bottom-wall body 47 having an opening 47A formed therein, and a fixing portion 46 having a screw hole 46A formed therein.

The bottom-wall body 47 has a plate shape that is generally rectangular in a bottom view and elongated in the left-right direction. The opening 47A is formed in the right end portion of the bottom-wall body 47. The opening 47A has a general rectangular shape in a bottom view and penetrates the bottom-wall body 47 vertically.

The fixing portion 46 is disposed on the bottom surface of the bottom-wall body 47 at a position to the right-rear side of the opening 47A and separated from the same. The fixing portion 46 has a plate shape that is generally rectangular in a front view. The fixing portion 46 extends in a direction from lower-front to upper-rear and protrudes diagonally downward and forward from the bottom surface of the bottom-wall body 47.

The screw hole 46A is formed in the approximate center region of the fixing portion 46. The screw hole 46A has a general rectangular shape in a front view and penetrates the fixing portion 46 in the front-rear direction.

The front wall 44 spans between the lower-front corners of the first side wall 41 and second side wall 42. The bottom edge of the front wall 44 is connected to the front edge of the bottom-wall body 47.

The rear wall (not shown) spans between the lower-rear corners of the first side wall 41 and second side wall 42. The bottom edge of the rear wall is connected to the rear edge of the bottom-wall body 47.

As shown in FIG. 1, the upper frame 38 has a box-like shape that is open on the bottom. The upper frame 38 is disposed on top of the lower frame 39.

As shown in FIGS. 3B and 4, the pressure roller 21 includes a shaft 61, a roller portion 62, and a pressure gear 63 (see FIG. 2) as an example of the gear.

The shaft 61 is formed of a metal and has a general columnar shape that is elongated in the left-right direction. The right end portion of the shaft 61 is rotatably supported in the lower portion of the first-side-wall body 50. The left end portion of the shaft 61 is rotatably supported in the lower portion of the second-side-wall body 55. Through this arrangement, the pressure roller 21 is rotatably supported in the lower frame 39. Further, the left end portion of the shaft 61 protrudes leftward from the second-side-wall body 55, as shown in FIG. 2.

The roller portion 62 is formed of a rubber material. The roller portion 62 may also contain well-known additives. The roller portion 62 has a general cylindrical shape that is elongated in the left-right direction. The roller portion 62 covers the circumferential surface of the shaft 61 in the left-right center region thereof, leaving the left-right end portions of the shaft 61 exposed. The roller portion 62 is arranged between the first side wall 41 and second side wall 42 with respect to the left-right direction.

The pressure gear 63 has a general cylindrical shape, with substantial thickness in the left-right direction. The pressure gear 63 has gear teeth formed around its entire circumferential surface. The pressure gear 63 is positioned on the left side of the second side wall 42 and is mounted on the left end portion of the shaft 61 so as to be incapable of rotating relative to the same.

In this way, the pressure roller 21 has an integral member including the pressure gear 63, shaft 61, and roller portion 62. The pressure roller 21 rotates about a rotational axis A shown in FIG. 4 that extends in the left-right direction. While not shown in the drawings, a motor or other drive source is provided in the main casing 2 for producing a drive force that is inputted into the pressure gear 63 during the image-forming operation described above.

The heat unit 22 is disposed above the pressure roller 21. The heat unit 22 includes a stay cover 71, a stay 72, a reflective plate 73, a heater 74, a heating plate 75, and an endless belt 76 as an example of a belt.

The stay cover 71 is formed of a heat-resistant resin material. The stay cover 71 has a box-like shape that is elongated in the left-right direction and open on the bottom. The front-rear dimension of the stay cover 71 is approximately equal to the front-rear dimension of the first recessed portion 50A.

The stay 72 is disposed inside the stay cover 71. The stay 72 is formed of a metal. The stay 72 has a general squared cylindrical shape that is elongated in the left-right direction and open on the bottom.

The reflective plate 73 is disposed inside the stay 72. The reflective plate 73 is formed of a metal. The reflective plate 73 has a general squared cylindrical shape that is elongated in the left-right direction and open on the bottom. The inner surface of the reflective plate 73 has a mirror finish.

The heater 74 is disposed inside the reflective plate 73. The heater 74 has a general columnar shape that is elongated in the left-right direction.

The heating plate 75 is arranged beneath the heater 74. The heating plate 75 is formed of metal and has a general flat plate shape that is elongated in the left-right direction. As shown in FIG. 4, the heating plate 75 is supported by the stay 72. With this arrangement, the stay 72 and heating plate 75 are electrically connected to each other.

The endless belt 76 is a flexible member that is heat-resistant and electrically conductive. The endless belt 76 has a general cylindrical shape that is elongated in the left-right direction. The left-right dimension of the endless belt 76 is smaller than the left-right dimension of the stay cover 71.

The endless belt 76 is placed around the stay cover 71, stay 72, reflective plate 73, heater 74, and heating plate 75 so that its inner circumferential surface contacts the heating plate 75. Hence, the endless belt 76 and heating plate 75 are electrically connected to each other, and the endless belt 76 is electrically connected to the stay 72 through the heating plate 75.

The right end portion of the stay cover 71 protrudes farther rightward than the right edge of the endless belt 76, and the left end portion of the stay cover 71 protrudes farther leftward than the left edge of the endless belt 76.

As shown in FIG. 2, the heat unit 22 having the above construction is supported in the lower frame 39 so as to be capable of sliding vertically, with the right end portion of the stay cover 71 received in the first recessed portion 50A of the first-side-wall body 50 and the left end portion of the stay cover 71 received in the second recessed portion 55A of the second-side-wall body 55. Accordingly, the heat unit 22 confronts the pressure roller 21 vertically, and the bottom surface of the endless belt 76 in the heat unit 22 contacts the top circumferential surface on the roller portion 62 of the pressure roller 21, as illustrated in FIG. 4. That is, the nip area N is formed by the bottom surface of the endless belt 76 and the roller portion 62 of the pressure roller 21.

As shown in FIG. 3B, the fixing portion 46 is positioned lower than the nip area N, i.e., on the pressure roller 21 side of the nip area N.

As shown in FIG. 2, the first pressing unit 80 is disposed above the first side wall 41. As shown in FIG. 3B, the first pressing unit 80 includes an arm 81 as an example of the pressing member, and an urging member 82. The arm 81 is an example of a metal arm. The urging member 82 is an example of a spring or a first spring.

The arm 81 is formed of a metal and is integrally provided with an arm body 83 having a recessed portion 83A, an anchoring portion 84, a bearing portion 85, a pressing portion 86, and a flange portion 87.

The arm body 83 has a plate shape that is generally rectangular in a side view and elongated in the front-rear direction.

The recessed portion 83A is formed in the rear portion of the arm body 83. The recessed portion 83A has a general U-shape in a side view that is open on the bottom. The recessed portion 83A is recessed upward from the bottom edge of the arm body 83.

The anchoring portion 84 is disposed inside the recessed portion 83A. The anchoring portion 84 protrudes rearward from the inner front surface of the recessed portion 83A, and then bends and extends upward so as to form a general L-shape in a side view.

The bearing portion 85 is disposed on the front end portion of the arm 81 below the front end portion of the arm body 83. The bearing portion 85 has a general C-shape in a side view with the opening of the "C" facing forward. The upper portion of the bearing portion 85 is connected to the front portion of the arm body 83.

The pressing portion 86 is disposed between the bearing portion 85 and the recessed portion 83A. The pressing portion 86 has a general rectangular shape in a side view and protrudes downward from the bottom edge of the arm body 83.

The flange portion 87 is disposed to the rear of and is separated from the pressing portion 86. As shown in FIG. 2, the flange portion 87 has a general U-shape in a plan view and opens toward the left side. The U-shaped flange portion 87 straddles the recessed portion 83A, connecting to the bottom edge along the rear portion of the arm body 83 on both front and rear sides of the recessed portion 83A.

As shown in FIG. 3B, the bearing portion 85 receives the first connecting shaft 54 so as to be capable of rotating relative to the same. Hence, the arm 81 is supported on the first side wall 41 while being capable of pivoting about the first connecting shaft 54.

The arm 81 is also disposed above the heat unit 22 such that the pressing portion 86 contacts the right side of the stay cover 71 from above.

The anchoring portion 84 of the arm 81 is positioned above the heat unit 22 and to the upper-rear side of the nip area N. The arm 81 also constitutes part of a second grounding member 79 described later.

The urging member 82 is disposed to the left of the first side wall 41 and beneath the flange portion 87 of the arm 81. The urging member 82 is also positioned rearward of and separated from the heat unit 22. The urging member 82 is a tension coil spring formed of a metal and elongated vertically. More specifically, the urging member 82 is configured of a single metal wire member. As shown in FIG. 4, the urging member 82 is integrally configured of a coil portion 82A, a hook portion 82B, and an annular portion 82C.

The coil portion 82A has an air core coil configuration whose axis extends vertically.

The hook portion 82B constitutes the top end portion of the urging member 82. The hook portion 82B has a general U-shape in a front view that is open on the bottom. The hook portion 82B is formed continuously with the top end portion of the coil portion 82A, extends first upward and then curves and extends downward.

The annular portion 82C constitutes the bottom end portion of the urging member 82. The annular portion 82C has an annular shape in a side view.

The hook portion 82B of the urging member 82 passes around the flange portion 87 through the recessed portion 83A and is anchored on the anchoring portion 84 of the arm 81. The annular portion 82C is anchored on the rear edge of the first side wall 41.

With this construction, the urging member 82 constantly urges the rear portion of the arm 81 downward. Consequently, the pressing portion 86 of the arm 81 presses downward on the right side of the arm 81, i.e., presses the stay cover 71 toward the pressure roller 21, as illustrated in FIG. 3B.

Further, since the hook portion 82B is in contact with the anchoring portion 84, the urging member 82 is electrically connected to the arm 81. The urging member 82 also serves as part of the second grounding member 79 described later.

As shown in FIG. 2, the second pressing unit 90 is disposed above the second side wall 42. A detailed description of the second pressing unit 90 has been omitted since the second pressing unit 90 has the same configuration as the first pressing unit 80. The second pressing unit 90 includes an arm 91, and an urging member (not shown).

The arm 91 of the second pressing unit 90 is supported on the second side wall 42 so as to be capable of pivoting about the second connecting shaft (not shown). Further, the urging member (not shown) of the arm 91 presses the left side of the stay cover 71 downward, i.e., toward the pressure roller 21.

As shown in FIGS. 3B and 4, the grounding unit 77 is disposed on the right end portion of the fixing device 5. The grounding unit 77 includes a first grounding member 78, and the second grounding member 79. The first grounding member 78 and the second grounding member 79 are examples of a first conducting member and a second conducting member, respectively.

As shown in FIG. 4, the first grounding member 78 functions to ground the pressure roller 21. The first grounding member 78 is disposed at leftward of the first side wall 41 and below the right end portion of the shaft 61. The first grounding member 78 is formed of a metal and is integrally provided with a first connecting portion 78A, and a first contact portion 78B as an example of a first contacting portion.

The first connecting portion 78A has a plate shape that is generally U-shaped in a front view and opens toward the left. The first connecting portion 78A is disposed with its top plate resiliently contacting the bottom surface of the shaft 61 at the right end portion of the same.

The first contact portion 78B is disposed on the front side of the first connecting portion 78A, and is formed continuously with the first connecting portion 78A. The first contact portion 78B has a general plate shape that extends in a direction from the upper front to the lower rear. The first contact portion 78B continues from the front edge on the bottom plate of the first connecting portion 78A and slopes upward toward the front.

As shown in FIG. 3A, the first grounding member 78 is fixed to the top surface of the bottom-wall body 47 at the right end thereof so that the first contact portion 78B is exposed on the underside of the lower frame 39 through the opening 47A formed in the bottom-wall body 47. As shown in FIG. 4, the top plate of the first connecting portion 78A constituting the first grounding member 78 elastically contacts the right end portion of the shaft 61 from below. Through this configuration, the first connecting portion 78A electrically connects the shaft 61 of the pressure roller 21 to the first contact portion 78B.

The second grounding member 79 functions to ground the heat unit 22. The second grounding member 79 includes a contact member 93, the arm 81 and urging member 82 described above, a spring 94, and a conductive member 95. The contact member 93 is an example of a second spring.

The contact member 93 electrically connects the stay 72 to the arm 81. The contact member 93 is disposed between the stay 72 and urging member 82 in the front-rear direction. The contact member 93 is a plate spring that is formed of a metal and extends vertically. The contact member 93 is integrally provided with a body portion 93A, a stay contact portion 93B, and an arm contact portion 93C.

The body portion 93A constitutes approximately the vertical center region of the contact member 93. The body portion 93A has a plate shape that is generally rectangular in a front view and elongated vertically.

The stay contact portion 93B constitutes the bottom end portion of the contact member 93. The stay contact portion 93B is formed continuously with the bottom end portion of the body portion 93A and slopes downward toward the front.

The arm contact portion 93C constitutes the top end portion of the contact member 93. The arm contact portion 93C is formed continuously with the top end portion of the body portion 93A and extends first diagonally upward and forward, then bends and extends upward, and finally bends and slopes upward toward the rear.

The stay contact portion 93B elastically contacts the rear wall of the stay 72 at the right end portion of the same in a direction from the rear. The arm contact portion 93C elastically contacts the front edge of the flange portion 87 constituting the arm 81 from the upper-front side thereof. In this way, the contact member 93 electrically connects the stay 72 and arm 81.

The spring 94 is disposed beneath the urging member 82. The spring 94 is a tension coil spring whose axis extends in a direction from the lower front to the upper rear. The top end portion of the spring 94 is anchored on the annular portion 82C of the urging member 82, thereby electrically connecting the spring 94 to the urging member 82.

The conductive member 95 is disposed on the lower-front side of the spring 94 and on the lower-rear side of the pressure roller 21. The conductive member 95 is formed of a metal and is integrally provided with a support portion 96, a coupling portion 98, and a second contact portion 97 having a groove 97A formed therein. The second contact portion is an example of a second contact portion.

The support portion 96 includes a plate-shaped portion 96A, and a plurality (two) of pawls 96B.

The plate-shaped portion 96A has a plate shape that is generally rectangular in a plan view. One of the two pawls 96B is disposed on each of the left and right ends of the plate-shaped portion 96A. The pawls 96B extend upward from the top surface of the corresponding left and right ends. The tops of the pawls 96B are formed in a hook shape.

The coupling portion 98 is disposed on the lower-rear side of the support portion 96. The coupling portion 98 includes a folded portion 98A, and an anchoring portion 98B.

The folded portion 98A has a plate shape that is V-shaped in a side view and opens upward. The folded portion 98A is formed continuously with the rear end portion of the plate-shaped portion 96A. The folded portion 98A extends downward from the right portion on the rear edge of the plate-shaped portion 96A, and then bends and extends back upward toward the rear. The anchoring portion 98B has a C-shape in a side view, with the opening of the "C" facing rearward. The anchoring portion 98B is connected to the upper-rear end portion of the folded portion 98A.

As shown in FIG. 3A, the second contact portion 97 is disposed leftward of and spaced apart from the coupling portion 98. As shown in FIG. 4, the second contact portion 97 has a general plate shape that extends in a direction from the lower front to the upper rear. The second contact portion 97 is formed continuously with the left portion on the rear edge of the plate-shaped portion 96A and slopes downward toward the front.

As shown in FIG. 3A, the groove 97A is formed in the bottom portion of the second contact portion 97. The groove 97A has a general U-shape in a front view with its opening facing downward. The groove 97A is recessed upward from the bottom edge of the second contact portion 97 in the approximate left-right center of the second contact portion 97. The left-right dimension of the groove 97A is greater than the left-right dimension of the screw hole 46A formed in the fixing portion 46.

The conductive member 95 is fixed to the bottom surface of the bottom-wall body 47 such that the second contact portion 97 is positioned on the front surface of the fixing portion 46. Specifically, the two pawls 96B of the support portion 96 are engaged with the bottom-wall body 47. In this way, the second contact portion 97 is exposed from the lower frame 39.

Therefore, the first contact portion 78B and second contact portion 97 are positioned on the same side of, i.e., below the bottom-wall body 47 of the lower frame 39, as shown in FIGS. 3A and 3B. Further, the first contact portion 78B and second contact portion 97 are positioned below, i.e., on the pressure roller 21 side of the nip area N between the pressure roller 21 and heat unit 22.

As shown in FIG. 3A, the folded portion 98A of the coupling portion 98 is disposed to the right of the fixing portion 46. As shown in FIG. 4, the anchoring portion 98B of the coupling portion 98 is disposed lower than the pressure roller 21 and on the lower rear side of the nip area N. The bottom end portion of the spring 94 is anchored on the anchoring portion 98B, thereby electrically connecting the spring 94 to the conductive member 95.

Hence, the contact member 93, arm 81, urging member 82, spring 94, and coupling portion 98 and support portion 96 of the conductive member 95 function as an example of a second connecting portion for electrically connecting the stay 72 of the heat unit 22 to the second contact portion 97 of the conductive member 95.

Further, the urging member 82 and spring 94 extend from the anchoring portion 84 of the arm 81 positioned above the nip area N to the anchoring portion 98B of the coupling portion 98 positioned below the nip area N. In other words, the urging member 82 and spring 94 extend from the heat unit 22 side of the nip area N to the pressure roller 21 side of the nip area N.

The printer 1 also includes a device-side ground 100.

The device-side ground 100 is disposed inside the main casing 2. The device-side ground 100 includes a first device-side ground 101 as an example of a device grounding member, and a second device-side ground 102. The device-side ground 100 is an example of a first body connecting portion.

The first device-side ground 101 corresponds to the first grounding member 78 of the fixing device 5 and includes a first device-side contact 101A, a first wire 101B, and a diode 101C.

The first device-side contact 101A corresponds to the first contact portion 78B of the first grounding member 78. The first device-side contact 101A is formed of a metal and has a general plate shape that extends along a direction from the upper front to the lower rear. The first wire 101B electrically connects the first device-side contact 101A to a reference potential 110 of the printer 1.

The diode 101C is a well-known Zener diode and is connected to a midpoint of the first wire 101B. The diode 101C is connected to the first wire 101B so that electric current flows in only one direction from the first device-side contact 101A to the reference potential 110.

The second device-side ground 102 corresponds to the second grounding member 79 of the fixing device 5. The second device-side ground 102 includes a second device-side contact 102A, and a second wire 102B. The second device-side ground 102 is an example of a second device grounding member.

The second device-side contact 102A corresponds to the second contact portion 97 of the second grounding member 79. The second device-side contact 102A is formed of a metal and has a general plate shape that extends in a direction from the lower front toward the upper rear. The second wire 102B electrically connects the second device-side contact 102A to the reference potential 110 of the printer 1.

As shown in FIG. 1, the fixing device 5 is used while mounted in the main casing 2. To mount the fixing device 5 in the main casing 2, the operator first places the rear cover 25 in its open position to expose the second access opening 24.

Next, the operator inserts the fixing device 5 into the main casing 2 through the second access opening 24 along a mounting direction X extending from the upper rear to the lower front, as shown in FIG. 4. Thus, the first contact portion 78B and the second contact portion 97 are positioned downstream in the mounting direction X from the bottom-wall body 47 of the lower frame 39, as shown in FIGS. 3A and 4.

During this operation, the first contact portion 78B of the first grounding member 78 contacts the first device-side contact 101A of the first device-side ground 101, as illustrated in FIG. 4. Hence, the first device-side ground 101 and first contact portion 78B become electrically connected.

Further, the second device-side contact 102A of the second device-side ground 102 is received between the second contact portion 97 of the second grounding member 79 and the fixing portion 46 in the front-rear direction. That is, the second device-side contact 102A is inserted between the second contact portion 97 and fixing portion 46.

This operation completes the operation for mounting the fixing device 5 in the main casing 2.

When the fixing device 5 is mounted in the main casing 2, it should be noted that the first engaging portion 51, second engaging portion 52, and third engaging portion 56 are all engaged with engaging ribs (not shown) provided in the main casing 2. These engagements fix the position of the fixing device 5 in the main casing 2.

Next, the operator fixes the fixing portion 46 of the fixing device 5 to the main casing 2 with a screw member 99, which is an example of a fastener. The screw member 99 is a well-known screw that is formed of a metal and includes a shank 99A, and a head 99B. The screw member 99 is an example of a metal screw.

The screw member 99 is screwed into the main casing 2 from the upper-front side of the second contact portion 97. In other words, the shank 99A of the screw member 99 is sequentially inserted through the groove 97A of the second contact portion 97, a hole (not shown) formed in the second device-side contact 102A, and the screw hole 46A of the fixing portion 46 and is screwed into the main casing 2. Hence, the groove 97A of the second contact portion 97 receives the shank 99A of the screw member 99.

Through this assembly, the fixing portion 46 is fixed to the main casing 2. At this time, the second contact portion 97 and second device-side contact 102A are interposed between the head 99B of the screw member 99 and the fixing portion 46. Through this configuration, the second contact portion 97 and second device-side contact 102A are reliably electrically connected via the screw member 99.

During the image-forming operation described above, the pressure roller 21 of the fixing device 5 is charged with a negative polarity (a negative charge). Providing the first device-side ground 101 with the diode 101C reliably maintains the negative charge on the pressure roller 21 since electric current cannot flow from the pressure roller 21 to the first grounding member 78.

On the other hand, the absolute value of charge on the heat unit 22 of the fixing device 5 is reduced since the heat unit 22 is directly connected to the reference potential 110 through the second grounding member 79 and second device-side ground 102 rather than through a diode. This arrangement maintains a large potential difference between the pressure roller 21 and heat unit 22.

Therefore, when a sheet P is inserted into the nip area N between the pressure roller 21 and heat unit 22 after a toner image has been transferred onto the sheet P, the negatively charged pressure roller 21 attracts the toner to the sheet P side since the toner carries a charge of positive polarity (a positive charge).

Further, ensuring a large potential difference between the pressure roller 21 and heat unit 22 reliably restrains toner from becoming deposited on the endless belt 76 of the heat unit 22.

When a sheet P passes through the nip area N after having a toner image transferred thereon, the heat unit 22 and pressure roller 21 apply heat and pressure to the sheet P, thermally fixing the toner image to the sheet P.

Incidentally, the definition of the metal arm includes an arm that is mainly made from metal and that has a nonmetal material as coating or filler; the definition of the metal screw includes a screw that is mainly made from metal and that has a nonmetal material as coating or filler.

(1) As shown in FIG. 4, the grounding unit 77 includes the first grounding member 78 for grounding the pressure roller 21, and the second grounding member 79 for grounding the heat unit 22. By grounding the pressure roller 21 and heat unit 22 separately, this construction facilitates the adjustment of the electric potential for each of the pressure roller 21 and heat unit 22. Thus, this arrangement can restrain toner from becoming deposited on the heat unit 22 (electrostatic offset).

Further, the grounding unit 77 has the urging member 82 and spring 94 that extend from a position above the nip area N to a position below the nip area N, and the first contact portion 78B and second contact portion 97 are positioned below the bottom-wall body 47 of the frame 31. Accordingly, the device-side ground 100 of the printer 1 can be accessed from the same side of the fixing device 5 as the first contact portion 78B and second contact portion 97. In other words, an efficient layout can be ensured for the first contact portion 78B and the second contact portion 97 that facilitates the first contact portion 78B and second contact portion 97 in contacting the device-side ground 100 of the printer 1 when the fixing device 5 is mounted in the printer 1. The device-side ground 100 is an example of a first body connecting portion.

Accordingly, this arrangement can facilitate accessing the first contact portion 78B and second contact portion 97 from the device-side ground 100 in order to ground both the pressure roller 21 and heat unit 22, while reducing contamination on the printing surfaces of sheets P.

(2) As shown in FIG. 4, the urging member 82 and spring 94 of the second grounding member 79 extend from the heat unit 22 side of the nip area N to the pressure roller 21 side of the nip area N. In this way, the first contact portion 78B and second contact portion 97 can be reliably arranged on the pressure roller 21 side of the nip area N.

(3) As shown in FIG. 4, the fixing portion 46 is positioned on the pressure roller 21 side of the nip area N. Hence, all of the fixing portion 46, first contact portion 78B, and second contact portion 97 are positioned on the pressure roller 21 side of the nip area N. Thus, the fixing portion 46, first contact portion 78B, and second contact portion 97 can be arranged in close proximity to each other, improving the positioning precision of the first contact portion 78B and second contact portion 97 relative to the main casing 2 when the fixing portion 46 is fixed to the main casing 2. Accordingly, when the fixing device 5 is mounted in the printer 1, the first contact portion 78B and the second contact portion 97 can be reliably connected electrically to the device-side ground 100.

(4) When the fixing portion 46 is fixed to the main casing 2 with the screw member 99, as illustrated in FIG. 4, the second contact portion 97 is electrically connected to the device-side ground 100 through the screw member 99. Therefore, the second contact portion 97 can be reliably connected to the device-side ground 100 by mounting the fixing device 5 in the printer 1 and fixing the fixing portion 46 to the main casing 2. In other words, this arrangement simultaneously achieves both the fixing of the fixing device 5 relative to the main casing 2 and the connecting of at least one of the first contact portion 78B and second contact portion 97 to the device-side ground 100.

(5) Further, the shank 99A of the screw member 99 is received in the groove 97A of the second contact portion 97 when the screw member 99 fastens the fixing portion 46 to the main casing 2. Accordingly, the second contact portion 97 can be reliably arranged between the head 99B of the screw member 99 and the fixing portion 46, thereby achieving a reliable electrical connection between the second contact portion 97 and device-side ground 100 through the screw member 99.

(6) As shown in FIG. 3B, the arm 81 presses the heat unit 22 toward the pressure roller 21, ensuring stable contact between the pressure roller 21 and heat unit 22. The arm 81 is formed of a metal and, as shown in FIG. 4, serves simultaneously as at least part of the second connecting unit, thereby reducing the number of required parts.

(7) As shown in FIG. 3B, the urging member 82 applies an urging force to the arm 81, enabling the arm 81 to press the heat unit 22 reliably against the pressure roller 21. Further, the urging member 82 is formed of a metal and, as shown in FIG. 4, serves simultaneously as at least part of the second connecting unit, thereby reducing the number of required parts.

(8) As shown in FIG. 4, the first contact portion 78B and the second contact portion 97 are positioned downstream of the frame 31 with respect to the mounting direction X in which the fixing device 5 is mounted in the main casing 2. Accordingly, the first contact portion 78B and second contact portion 97 can both be smoothly connected to the device-side ground 100 when the fixing device 5 is mounted in the main casing 2.

(9) As shown in FIG. 2, the grounding unit 77 is positioned on the right end portion of the fixing device 5, i.e., the end opposite the pressure gear 63. Therefore, if the left end portion of the fixing device 5 were to joggle when a drive force is inputted into the pressure gear 63, the first grounding member 78 and second grounding member 79 would remain reliably connected to the 100.

(10) As shown in FIG. 1, the printer 1 is provided with the fixing device 5, and the pressure roller 21 and heat unit 22 can be grounded while preventing the printing surfaces of sheets P from becoming contaminated.

(11) As shown in FIG. 4, the first device-side ground 101 that is electrically connected to the first grounding member 78 includes the diode 101C. The diode 101C allows electric current to flow in only one direction from the pressure roller 21 toward the reference potential 110, thereby ensuring that the pressure roller 21 is maintained with a negative charge. On the other hand, the heat unit 22 is directly connected to the reference potential 110 without passing through a diode, thereby reducing the absolute value of its charge. Hence, this arrangement can reliably restrain toner from becoming deposited on the heat unit 22 by ensuring a reliable electric potential for both the pressure roller 21 and the heat unit 22.

In the embodiment described above, the toner is charged with a positive polarity while the pressure roller 21 is charged with a negative polarity during image-forming operations, but the toner may be a negative charging toner that is charged with a negative polarity. In this case, the pressure roller 21 is charged with a positive polarity during image-forming operations.

Note that the embodiment described above may be combined suitably with any of the variations described above. Further, the left-right direction is an example of the longitudinal direction, while the up-down (vertical) direction is an example of a first direction.

While the description has been made in detail with reference to specific embodiment thereof, it would be apparent to those skilled in the art that various changes and modifications may be made therein without departing from the spirit and scope of the above described embodiment.

What is claimed is:

1. A fixing device configured to be mounted in a main body of an image forming apparatus comprising a body connecting portion, the fixing device comprising:

a first fixing member including a roller;

a second fixing member comprising a belt configured to form a nip region in cooperation with the first fixing member, the first fixing member being positioned at a first side and the second fixing member being positioned at a second side opposite to the first side with respect to the nip region;

a first conducting member comprising a first contacting portion configured to contact the body connecting portion, and a first connecting portion electrically connecting the first fixing member and the first contacting portion; and a second conducting member comprising a second contacting portion configured to contact the body connecting portion, and a second connecting portion electrically connecting the second fixing member and the second contacting portion, both of the first contacting portion and the second contacting portion being positioned at the first side.

2. The fixing device according to claim 1, wherein the second connecting portion comprises a metal arm configured to press the second fixing member toward the first fixing member, and a spring engaged with the metal arm.

3. The fixing device according to claim 1, further comprising a spring; and wherein the second connecting portion comprises a metal arm configured to press the second fixing member toward the first fixing member, the metal arm engaging with the spring.

4. The fixing device according to claim 1, further comprising a metal arm configured to press the second fixing member toward the first fixing member; and wherein the second connecting portion comprises a spring engaged with the metal arm.

5. The fixing device according to claim 1, further comprising:

a metal arm configured to press the second fixing member toward the first fixing member;

a first spring engaged with the metal arm; and a second spring electrically connecting the first fixing member and the metal arm.

6. The fixing device according to claim 1, wherein the body connecting portion has:

a first portion which the first contacting portion contacts; and a second portion which the second contacting portion contacts.

7. The fixing device according to claim 6, wherein the first portion of the body connecting portion is spaced apart from the second portion of the body connecting portion.

8. The fixing device according to claim 7, wherein the first portion of the body connecting portion is grounded via a diode, and wherein the second portion of the body connecting is grounded without the diode.

9. The fixing device according to claim 6, wherein the body connecting portion is grounded.

10. The fixing device according to claim 1, wherein at least one of the first connecting portion and the second connecting portion extends from the first side to the second side.

11. The fixing device according to claim 10, wherein the second connecting portion extends from the first side to the second side.

12. A fixing device configured to be mounted in a main body of an image forming apparatus comprising a body connecting portion, the fixing device comprising:

a spring;

a first fixing member;

a second fixing member comprising a belt configured to form a nip region in cooperation with the first fixing member, the first fixing member being positioned at a first side and the second fixing member being positioned at a second side opposite to the first side with respect to the nip region;

a first conducting member comprising a first contacting portion configured to contact the body connecting portion, and a first connecting portion electrically connecting the first fixing member and the first contacting portion; and a second conducting member comprising a second contacting portion configured to contact the body connecting portion, and a second connecting portion electrically connecting the second fixing member and the second contacting portion, both of the first contacting portion and the second contacting portion being positioned at the first side, the second connecting portion comprising a metal arm configured to press the second fixing member toward the first fixing member, the metal arm engaging with the spring.

13. The fixing device according to claim 12, wherein the body connecting portion has:

a first portion which the first contacting portion contacts; and a second portion which the second contacting portion contacts.

14. The fixing device according to claim 13, wherein the first portion of the body connecting portion is spaced apart from the second portion of the body connecting portion.

15. The fixing device according to claim 14, wherein the first portion of the body connecting portion is grounded via a diode, and wherein the second portion of the body connecting portion is grounded without the diode.

16. The fixing device according to claim 13, wherein the body connecting portion is grounded.

17. The fixing device according to claim 12, wherein at least one of the first connecting portion and the second connecting portion extends from the first side to the second side.

18. The fixing device according to claim 17, wherein the second connecting portion extends from the first side to the second side.

19. The fixing device according to claim 12, wherein the second connecting portion comprises the spring.

20. The fixing device according to claim 19, wherein the spring is a coil spring.

21. A fixing device configured to be mounted in a main body of an image forming apparatus comprising a first body connecting portion and a second body connecting portion different from the first body connecting portion, the fixing device comprising:

a first fixing member;

a second fixing member comprising a belt configured to form a nip region in cooperation with the first fixing member, the first fixing member being positioned at a first side and the second fixing member being positioned at a second side opposite to the first side with respect to the nip region;

a first conducting member comprising a first contacting portion configured to contact the first body connecting portion, and a first connecting portion electrically connecting the first fixing member and the first contacting portion, the first body connecting portion configured to ground the first contacting portion; and a second conducting member comprising a second contacting portion configured to contact the second body connecting portion, and a second connecting portion electrically connecting the second fixing member and the second contacting portion, both of the first contacting portion and the second contacting portion being positioned at the first side, the second body connecting portion configured to ground the second contacting portion.

22. The fixing device according to claim 21, wherein the first body connecting portion is grounded via a diode, and wherein the second body connecting portion is grounded without the diode.

23. The fixing device according to claim 21, wherein the second body connecting portion extends from the first side to the second side.

* * * * *